US011035647B2

(12) United States Patent
Brown

(10) Patent No.: US 11,035,647 B2
(45) Date of Patent: Jun. 15, 2021

(54) KNIFE FOR DETACHABLY ATTACHING TO A FIREARM GRIP

(71) Applicant: Southern Grind, Inc., Peachtree City, GA (US)

(72) Inventor: Zachary Alexander Brown, Fayetteville, GA (US)

(73) Assignee: SOUTHERN GRIND, INC., Peachtree City, GA (US)

( * ) Notice: Subject to any disclaimer, the term of this patent is extended or adjusted under 35 U.S.C. 154(b) by 0 days.

(21) Appl. No.: 16/747,161

(22) Filed: Jan. 20, 2020

(65) Prior Publication Data

US 2020/0232754 A1 Jul. 23, 2020

Related U.S. Application Data

(60) Provisional application No. 62/794,632, filed on Jan. 20, 2019.

(51) Int. Cl.
*F41C 27/16* (2006.01)
*F41C 23/16* (2006.01)

(52) U.S. Cl.
CPC ..... *F41C 27/16* (2013.01); *F41C 23/16* (2013.01)

(58) Field of Classification Search
CPC ..... F41C 27/16; F41C 23/16; F41C 23/22; F41C 27/18; F41C 27/20
USPC ..... 42/53, 1.08, 1.09, 52, 86, 106
See application file for complete search history.

(56) References Cited

U.S. PATENT DOCUMENTS

| | | | | |
|---|---|---|---|---|
| 1,023,741 | A * | 4/1912 | Kreith | F41C 27/16 42/53 |
| 5,594,967 | A * | 1/1997 | Morton | B26B 3/06 30/138 |
| 5,924,233 | A * | 7/1999 | Strobel | F41C 23/04 42/72 |
| 7,146,762 | B1 * | 12/2006 | Leung | F41C 23/22 42/86 |
| 8,196,328 | B2 * | 6/2012 | Simpkins | F41C 23/22 42/73 |
| 8,661,723 | B2 * | 3/2014 | Emde | F41C 27/00 42/71.02 |
| 10,508,885 | B1 * | 12/2019 | Kauffman, Jr. | F41C 27/18 |
| 2014/0230303 | A1 * | 8/2014 | Rice | F41C 27/16 42/90 |
| 2016/0327372 | A1 * | 11/2016 | Schrock | F41G 1/01 |

OTHER PUBLICATIONS

NPL: https://ar15news.wordpress.com/2011/04/22/sneak-peek-new-samson-mfg-ar-grip-knife-insert/ Apr. 22, 2011.*

* cited by examiner

*Primary Examiner* — John Cooper
(74) *Attorney, Agent, or Firm* — Thomas | Horstemeyer, LLP

(57) ABSTRACT

Disclosed are various embodiments for a knife configured to be positioned, at least partially, within a grip of a firearm. The knife may include a blade body having a first blade side and a second blade side. The blade body may include a base and a knife edge portion. The knife may further include a handle portion. The handle portion may include the base of the blade body, a first handle attachment coupled to the base on the first blade side, and a second handle attachment coupled to the base on the second blade side. The knife may include an attachment mechanism for positioning at least the knife edge portion within an interior of the grip of the firearm.

20 Claims, 8 Drawing Sheets

KNIFE FOR DETACHABLY ATTACHING TO A FIREARM GRIP

CROSS-REFERENCE TO RELATED APPLICATION

This patent application claims the benefit of and priority to U.S. Provisional Application No. 62/794,632 entitled "KNIFE FOR DETACHABLY ATTACHING TO A FIREARM GRIP," filed Jan. 20, 2019, the contents of which being incorporated by reference in their entirety herein.

BACKGROUND

Certain types of firearms include the capability of attaching a knife, sword, or other sharp weapon thereon for use in close-combat situations. Most commonly, bayonets were used to position a sharp object on an end of a rifle, allowing the rifle to be used as a spear. Modern bayonets exist that are capable of being equipped on modern firearms, such as the AK-47. However, bayonets are often heavy and impair an operator's ability to fire the weapon in an accurate manner. As such, the use of bayonets is falling out of favor for use by modern militaries, hunters, hobbyists, and home defense operators. As such, those using firearms often carry a knife in a hilt or a pocket in the event a sharp object is needed for close encounters.

BRIEF DESCRIPTION OF THE INVENTION

According to various embodiments, a knife is disclosed that is configured to be positioned, at least partially, within a grip of a firearm. In some embodiments, the knife includes a blade body having a first blade side and a second blade side. The blade body may include a base and a knife edge portion. The knife may further include a handle portion. The handle portion may include the base of the blade body, a first handle attachment coupled to the base on the first blade side, and a second handle attachment coupled to the base on the second blade side.

The knife may further include a guard. In some embodiments, the guard may be positioned between the base and the knife edge portion. The guard may include an attachment mechanism coupled thereto being adapted to detachably attach to a grip of a firearm, such as a pistol, shotgun, or rifle, and sheath at least the knife edge portion in an interior of the grip. Each of the base of the knife, the first handle attachment, and the second handle attachment may include a recess defining a finger support structure. The finger support structure may include circular ribs, each of the at least two circular ribs being adapted to support a respective finger of the operator. In some embodiments, the finger support structure includes only two circular ribs, wherein a first one of the ribs is sized and positioned to support an index finger and a second one of the ribs is sized and positioned to support a middle finger of the operator.

Further, the guard may include a flat surface having an elongated aperture configured to nest a portion of the blade therein. The guard may include a first side projecting beyond the first blade side and a second side projecting beyond the second blade side. The attachment mechanism may project perpendicularly from the flat surface. Further, the attachment mechanism may include a circular recess positioned on an outer face of the attachment mechanism, the circular recess comprising a male detent mechanism configured to detachably attach to a female detent mechanism positioned in the interior of the grip of the firearm. As such, the attachment mechanism may be configured to release from the grip of the firearm in response to an application of a horizontal lateral force relative to a longitudinal axis of the firearm.

The first handle attachment and the second handle attachment may be positioned on the base of the blade body to define a tang of the knife. In some embodiments, the tang of the blade may include a plurality of ridges. Further, the first handle attachment and the second handle attachment may be coupled to the blade using a plurality of screws and a plurality of rivet nuts, or other suitable connection mechanisms. The guard may be further coupled to the blade via a pin positioned through an aperture positioned on sides of the flat surface and an aperture positioned on a rear portion of the blade.

In accordance with various embodiments described herein, a firearm comprising a knife is disclosed. The firearm may include a grip. The knife of the firearm may be configured to be sheathed within an interior of the grip. The knife may include, for example, a blade body having a first blade side and a second blade side. The blade body may further include a base and a knife edge portion.

The knife may further include a handle portion. The handle portion may include the base of the blade, a first handle attachment coupled to the base on the first blade side, a second handle attachment coupled to the base on the second blade side. A guard may be positioned between the base and the knife edge portion, where the guard comprises an attachment mechanism coupled thereto. The attachment mechanism may be configured to detachably attach to a grip of the firearm and sheath at least the knife edge portion in an interior of the grip. In some embodiments, the firearm comprises a rifle, such as an AK-47 or an AR-15.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to a knife adapted to detachably attach to a firearm. More specifically, a knife is disclosed that may be configured to sheath within a grip of a firearm, such as an AK-47, AR-15, or other suitable firearm. As noted above, modern bayonets exist that are capable of being equipped on modern firearms, such as the AK-47. However, bayonets are often heavy and impair an operator's ability to fire the weapon in an accurate manner. The use of bayonets is falling out of favor for use by modern militaries, hunters, hobbyists, and home defense operators. As such, those using firearms often carry a knife in a hilt or a pocket in the event a sharp object is needed for close encounters.

Accordingly, in various embodiments, a knife is described that is configured to sheath within an interior of a grip or other suitable portion of a firearm, such as a rifle, shotgun, or a pistol. The knife may be configured such that is can quickly be removed from the firearm by an operator during close encounters, such as close-combat situations or encounters with dangerous animals while hunting. Additionally, the knife may be configured such that the knife does not add substantial weight to the weight while not impairing the accuracy or precision of the operator when discharging projectiles using the firearm. Finally, the knife may provide an extension to the grip of the firearm such that a base of the knife can be used as a resting point when the firearm is positioned on the ground, for instance, when the firearm is used for long-distance shots.

In various embodiments, the knife may include, for example, a blade body having a first blade side and a second blade side. Additionally, the blade body may further include a base and a knife edge portion. The knife may further include a handle portion. The handle portion may include, for example, the base of the blade positioned between a first handle attachment coupled to the base on the first blade side, and a second handle attachment coupled to the base on the second blade side. A guard may be positioned between the base and the knife edge portion. In some embodiments, the guard comprises an attachment mechanism being adapted to detachably attach to a grip of a rifle and sheath at least the knife edge portion in an interior of the grip. The attachment mechanism facilitates a quick removal of the knife from the grip of the firearm, as will be described.

In the following discussion, a general description of the knife adapted to detachably attach to a grip of a firearm and its components is provided, followed by a discussion of the operation of the same.

Figure 1:
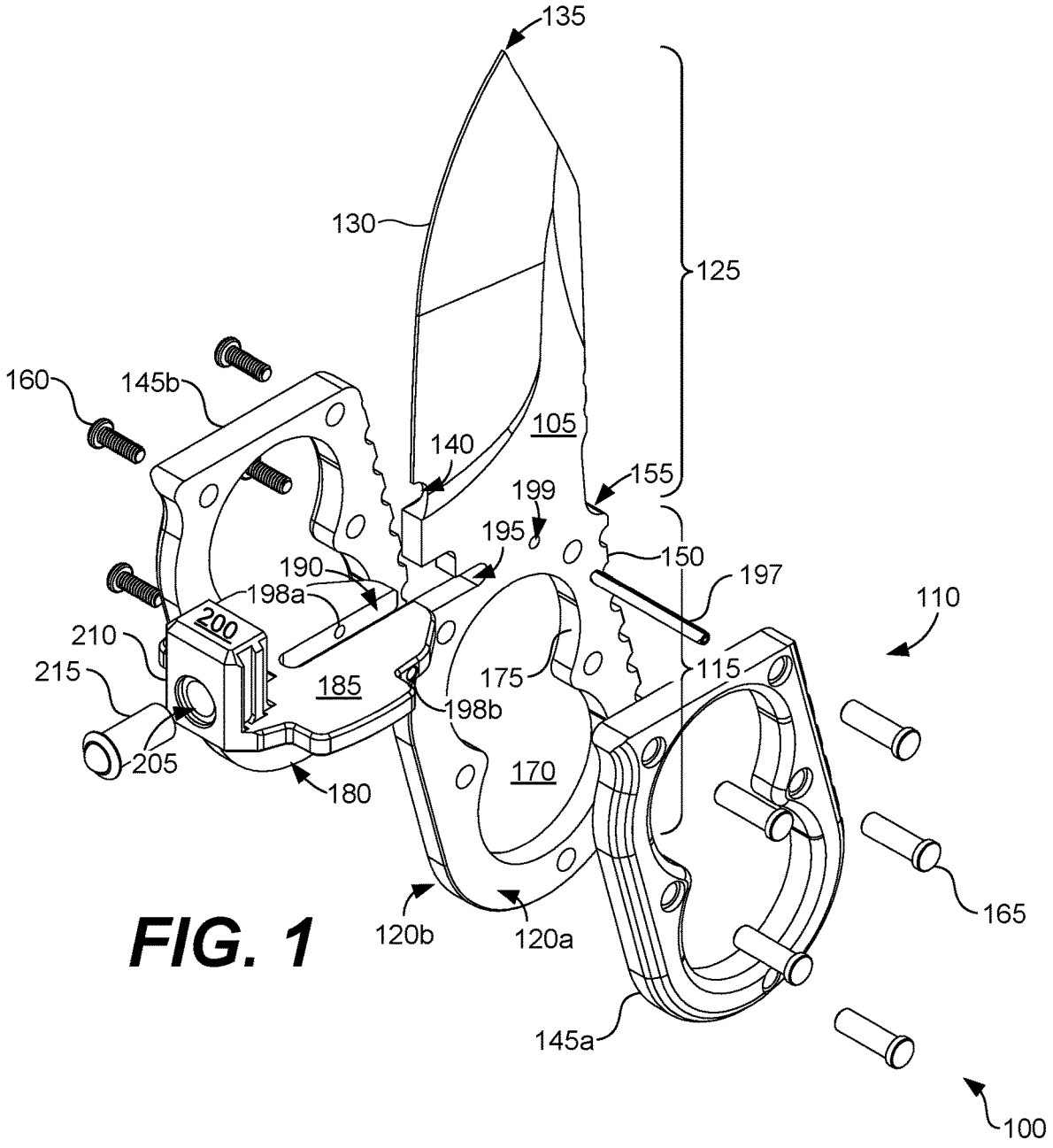
FIG. 1 shows an exploded perspective view of a knife adapted to detachably attach to a firearm grip according to various embodiments of the present disclosure.
Figure 6:
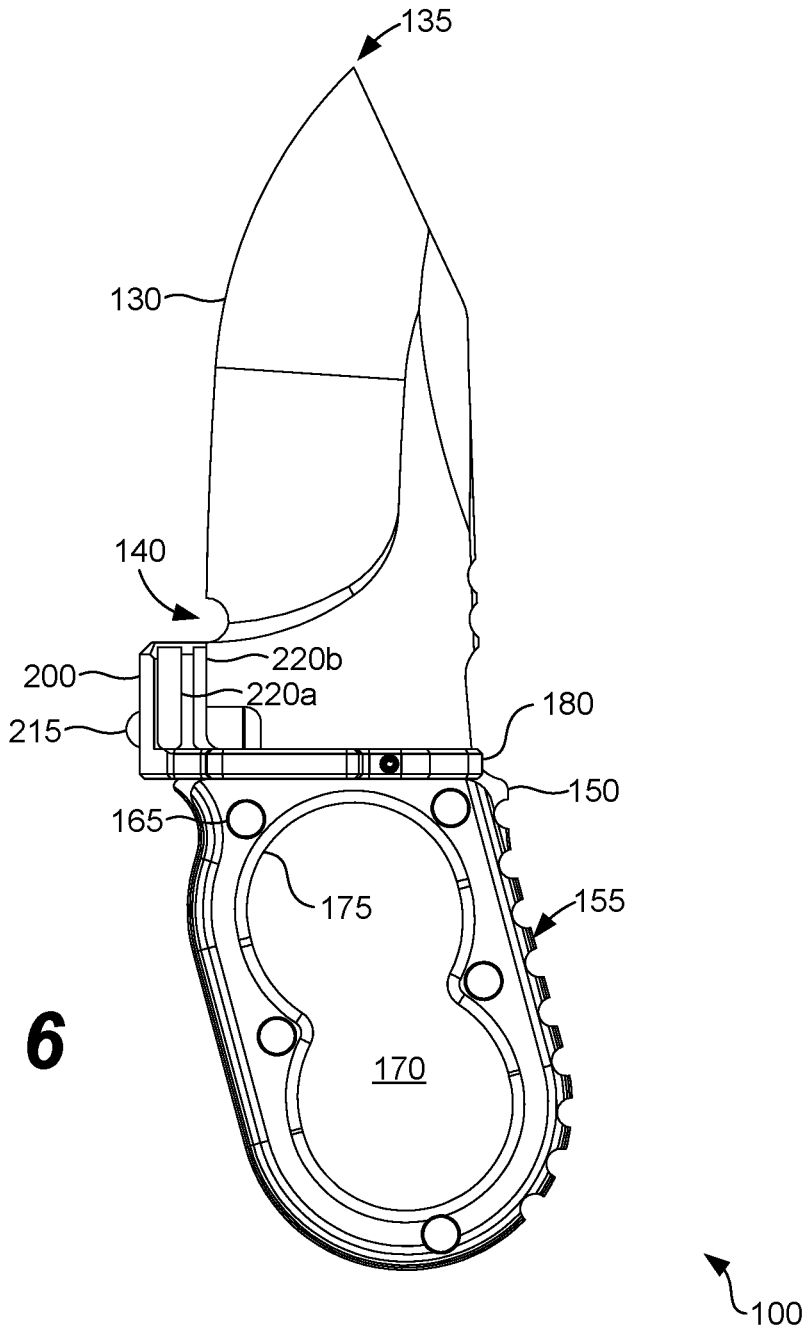
FIG. 6 shows a front evaluation view of the knife of FIG. 1 according to various embodiments of the present disclosure.
Figure 7:
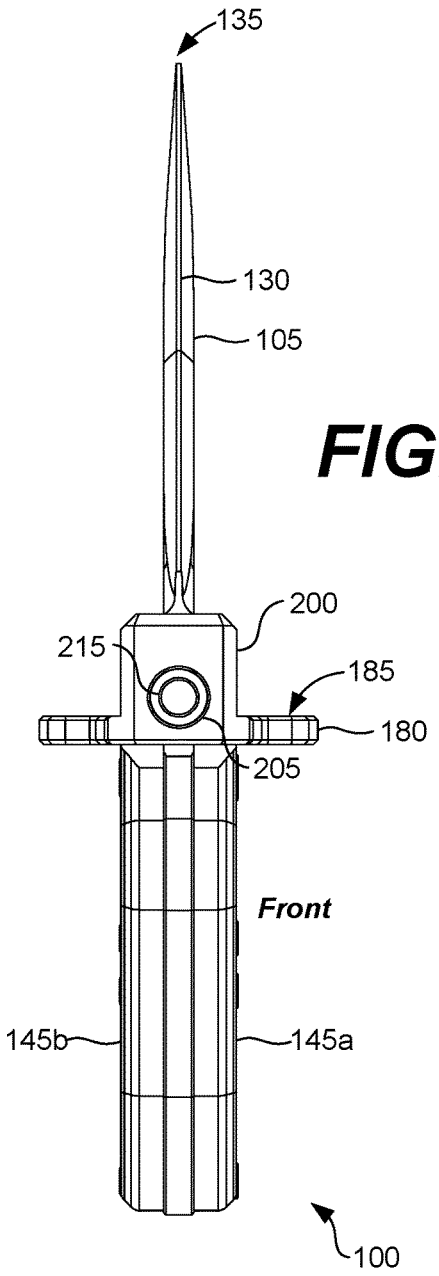
FIG. 7 shows a side elevation view of the knife of FIG. 1 according to various embodiments of the present disclosure.
Figure 8:
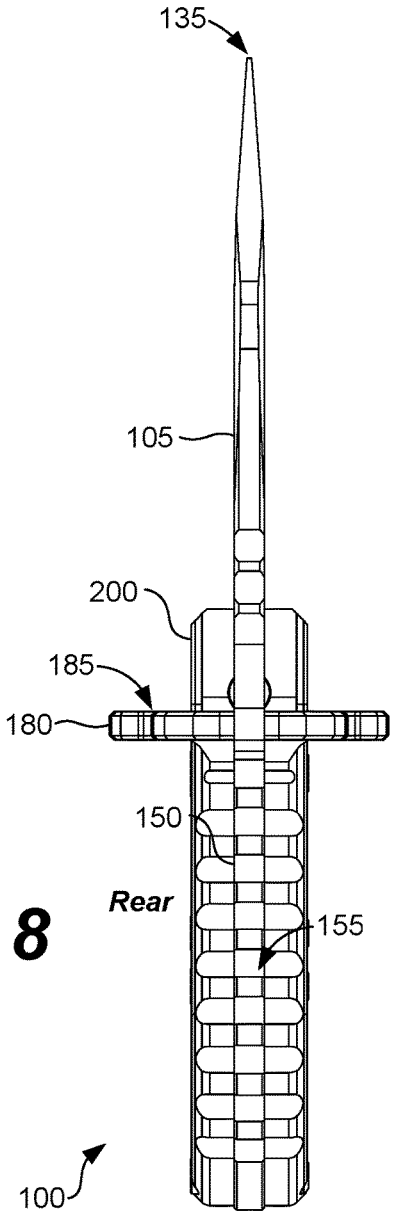
FIG. 8 shows a rear elevation view of the knife of FIG. 1 according to various embodiments of the present disclosure.

An exploded perspective view of a knife 100 is shown in FIG. 1 according to various embodiments. Various perspective views of the knife 100 are shown in FIG. 2-5. FIG. 6 shows a side elevation view of the knife 100 according to various embodiments. FIGS. 7 and 8 show front and rear views of the knife 100, respectively. Referring to FIG. 1 for explanatory purposes, the knife 100 is shown as having a blade body 105 and a handle portion 110 where, in some embodiments, the handle portion 110 includes a base 115 of the blade body 105. The blade body 105 may include a single, uniform piece of material, such as steel, stainless steel, titanium, aluminum, wood, bone, or other suitable material. The blade body 105 may be described as having a first blade side 120*a* and a second blade side 120*b*, as may be appreciated.

In addition to the base 115, the blade body 105 may further include a knife edge portion 125. Generally, the base 120 may include a lower portion of the blade body 105 and the knife edge portion 125 may include an upper portion of the blade body 105, such as the portion that extends above a guard, as will be discussed. The knife edge portion 125 may include a blade edge 130, a tip 135, a hook 140, as well as other components. The hook 140 may include a notched-out portion of the blade body 105, as may be appreciated.

In addition to the base 115 of the blade body 105, the handle portion 110 may further include a first handle attachment 145*a* and a second handle attachment 145*b* (collectively "handle attachments 145"). The first handle attachment 145*a* may be coupled to the base 115 on the first blade side 115*a* and, similarly, the second handle attachment 145*b* may be coupled to the base 115 on the second blade side 115*b*. The handle attachments 145 may be formed of a material different than the blade body 105 in some embodiments, such as plastic, wood, bones, metal, or other suitable material. In other embodiments, the knife 100 may not include the handle attachments 145. For instance, the base 115 may be wrapped with paracord, tape, or other covering to protect the hand of the operator.

By virtue of the size and placement of the first handle attachment 145*a* and the second handle attachment 145*b* on the blade body 105, a tang 150 may be defined at a base of the knife 100. The tang 150 of the blade body 105 may include a plurality of ridges 155 in various embodiments. The ridges 155 may facilitate grip by the operator. In various embodiments, the first handle attachment 145*a* and the second handle attachment 145*b* may be coupled to the blade body 105 using, for example, a plurality of screws 160 and a plurality of rivet nuts 165. Other suitable coupling mechanisms may be employed in similar or alternative embodiments.

According to various embodiments, each of the base 115, the first handle attachment 145*a*, and the second handle attachment 145*b* may include a recess 170. The recess 170 may include a shape defining a finger support structure 175. By virtue of the shape of the recess 170, the finger support structure 175 may include, for example, one or more circular ribs adapted to support one or more fingers of an operator of the knife 100. As such, the recess 170 may be described as having two notched-out circular regions, where the recess 170 resembles the number "8." Thus, in some embodiments, the recess 170 may be referred to as an 8-shaped recess.

Figure 2:
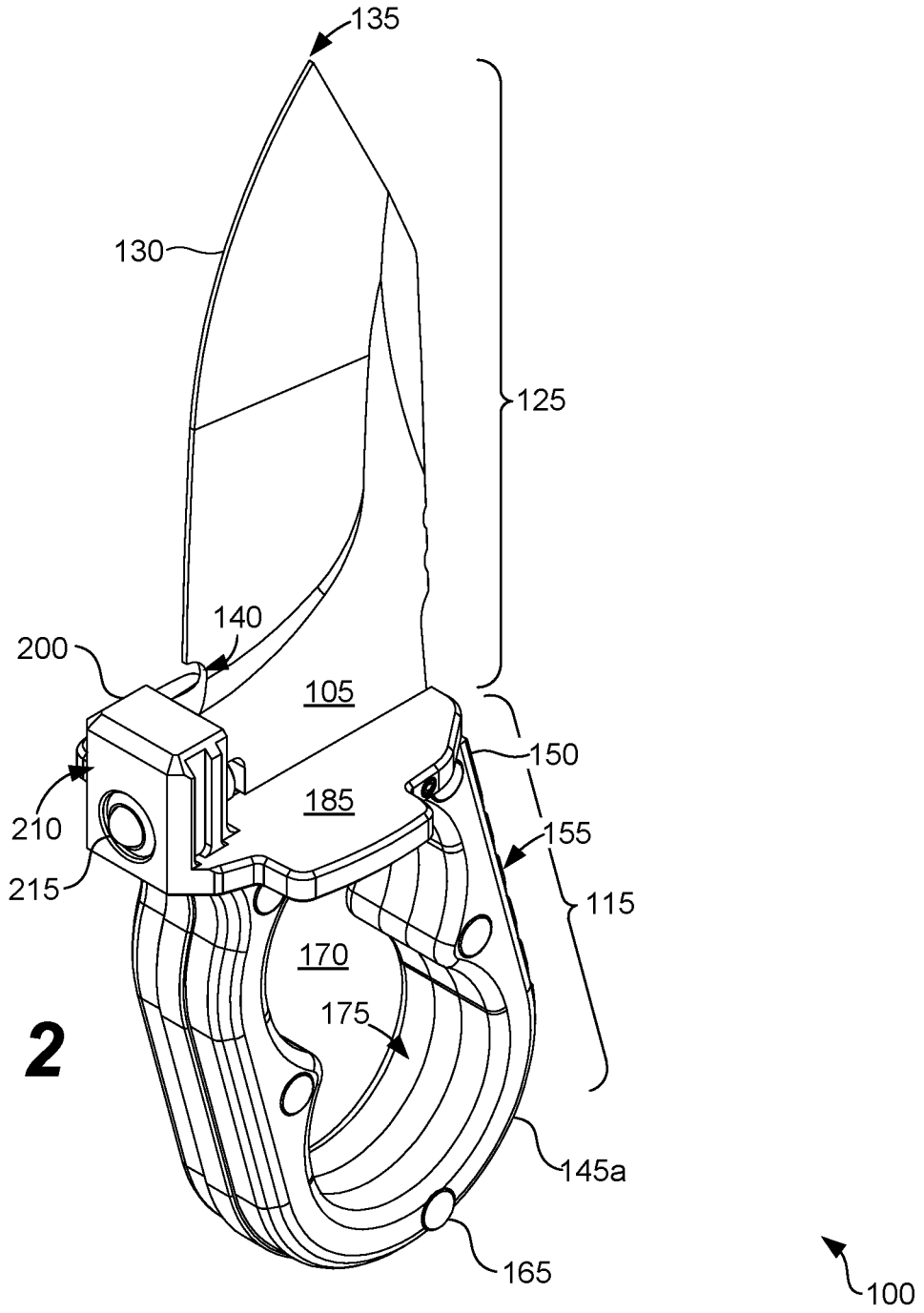
FIG. 2 shows a front perspective view of the knife of FIG. 1 according to various embodiments of the present disclosure.

As shown in FIG. 2, the finger support structure 175 may include only two circular ribs although, in other embodiments, the finger support structure 175 may include one, three, four, or other suitable amount of circular ribs. The finger support structure 175 provides an ergonomically efficient knife having ribs that fit the natural curve of the clasped fingers of the operator, while efficiently aiding quick removal of the knife 100 from a firearm. In embodiments in which the finger support structure 175 includes only two circular ribs, a first one of the ribs may be sized and positioned to support an index finger of an operator while a second one of the ribs may be sized and positioned to support a middle finger of the operator.

The knife 100 may further include a guard 180. As shown in FIG. 1, in various embodiments, the guard 180 may be positioned between the base 115 of the blade body 105 and the knife edge portion 125. The guard 180 may prevent fingers of the operator from sliding upwards and contacting the blade edge 130 when the knife 100 is in use, as may be appreciated. To this end, the guard 180 may include a surface 185 that projects beyond a surface of the first blade side 120*a* and the second blade side 120*b* in some embodiments. As shown in FIG. 1, the surface 185 of the guard 180 may include a substantially flat surface.

Further, the guard 180 and, more specifically, the surface 185 of the guard 180 may include an elongated aperture 190 configured to nest a portion of the blade body 105 therein. In some embodiments, the elongated aperture 190 is vertically defined such that it mates with a blade aperture 195 horizontally positioned on the blade body 105. The guard 180 may be further coupled to the blade body 105 via a pin 197 positioned through guard apertures 198*a*, 198*b* on respective sides of the surface 185, and a blade body aperture 199 positioned on a rear portion of the blade body 105.

In further embodiments, the guard 180 may include an attachment mechanism 200, where the attachment mechanism 200 is adapted to detachably attach to a grip of a rifle (not shown) such that at least the knife edge portion 125 is sheathed within an interior of the grip. As shown in FIG. 1, the attachment mechanism 200 may include a substantially square or rectangular element that projects perpendicularly from the surface 185 of the guard 180. Further, the attachment mechanism 200 may be positioned on a distal end of the surface 185 of the guard 180. In the embodiment shown in FIG. 2, only a single attachment mechanism 200 is shown, although, in other embodiments, multiple attachment mechanisms 200 may be employed.

The attachment mechanism 200 may include a recess 205 positioned on an outer face 210 of the attachment mechanism 200. For instance, the recess 205 may include a circular recess having a male detent mechanism 215 configured to detachably attach to a female detent mechanism (not shown), which may be positioned in an interior region of a rifle 300 or other firearm, such as an interior of a grip 303 of the rifle 300, as shown in FIGS. 9 and 10.

As may be appreciated, the attachment mechanism 200 may be configured to release the knife 100 from the grip 303 of a rifle 300 or other firearm. For instance, in various embodiments, the attachment mechanism 200 may be configured to release the knife 100 from the grip 303 of the rifle 300 in response to an application of a horizontal lateral force Fi relative to a longitudinal axis of the rifle 300. In other words, to release the knife 100 from the grip 303 of the rifle 300, an operator of the rifle 300 may insert his or her fingers into the finger support structure 175 and pull backwards towards a rear of the knife 100 and a rear of the rifle 300, which causes the male detect mechanism 215 to disengage from a female detent mechanism (not shown) positioned in an interior of the grip 303 or other region of the rifle 300.

Figure 9:
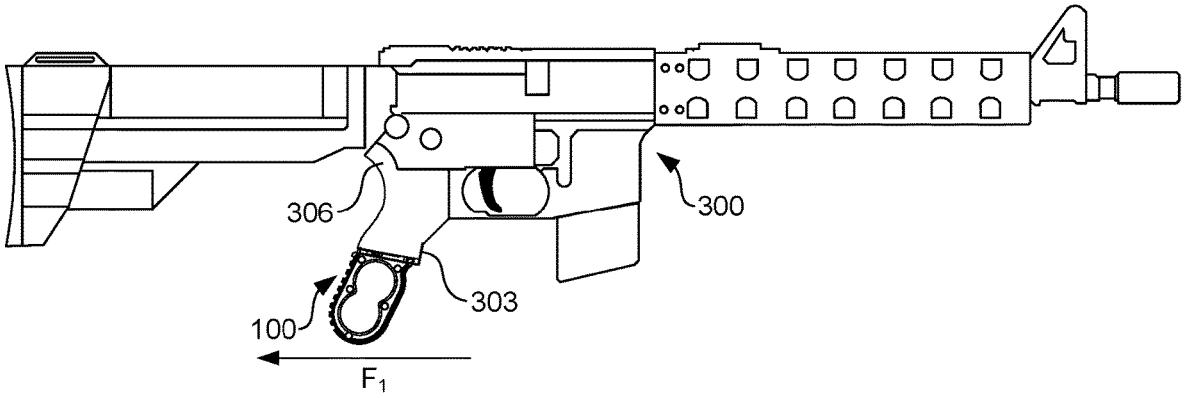
FIG. 9 shows a side elevation view of the knife of FIG. 1 positioned in an interior region of a rifle according to various embodiments of the present disclosure.
Figure 10:
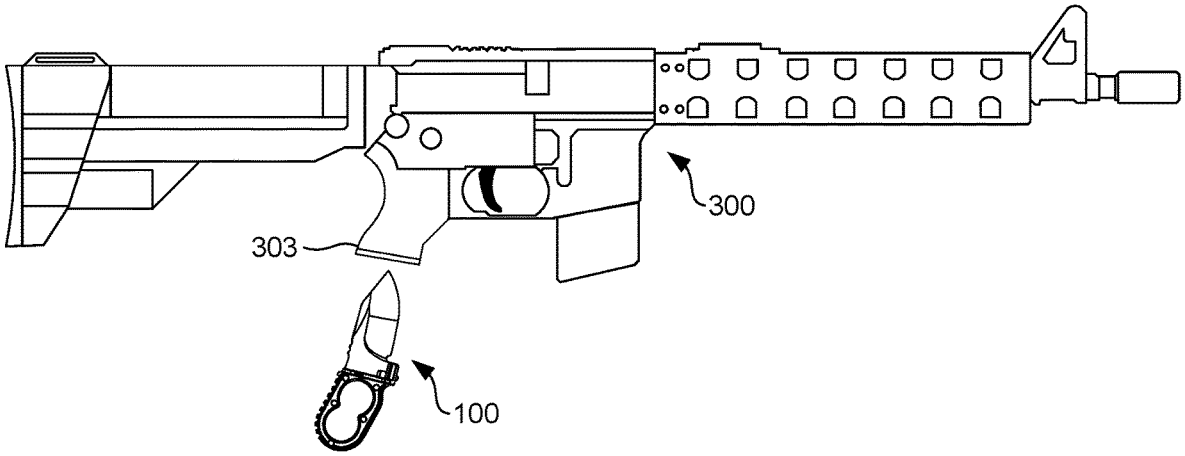
FIG. 10 shows a side elevation view of the knife of FIG. 1 removed from an interior region of a rifle according to various embodiments of the present disclosure.

As shown in FIG. 9, the knife 100 is shown positioned in the interior of the grip 303 of the rifle 300 or, in other words, the knife 100 is sheathed in the rifle 300. In FIG. 10, however, the knife 100 is shown removed from the interior of the grip 303 of the rifle 300. In some embodiments, the grip 303 includes a portion of the rifle 300 extending from a lower receiver 306 of the rifle 300.

In some embodiments, the guard 180 and the attachment mechanism may be integral to the blade body 105. In other words, the guard 180 and the attachment mechanism 200 may be formed from a same billet as the blade body 105.

Figure 3:
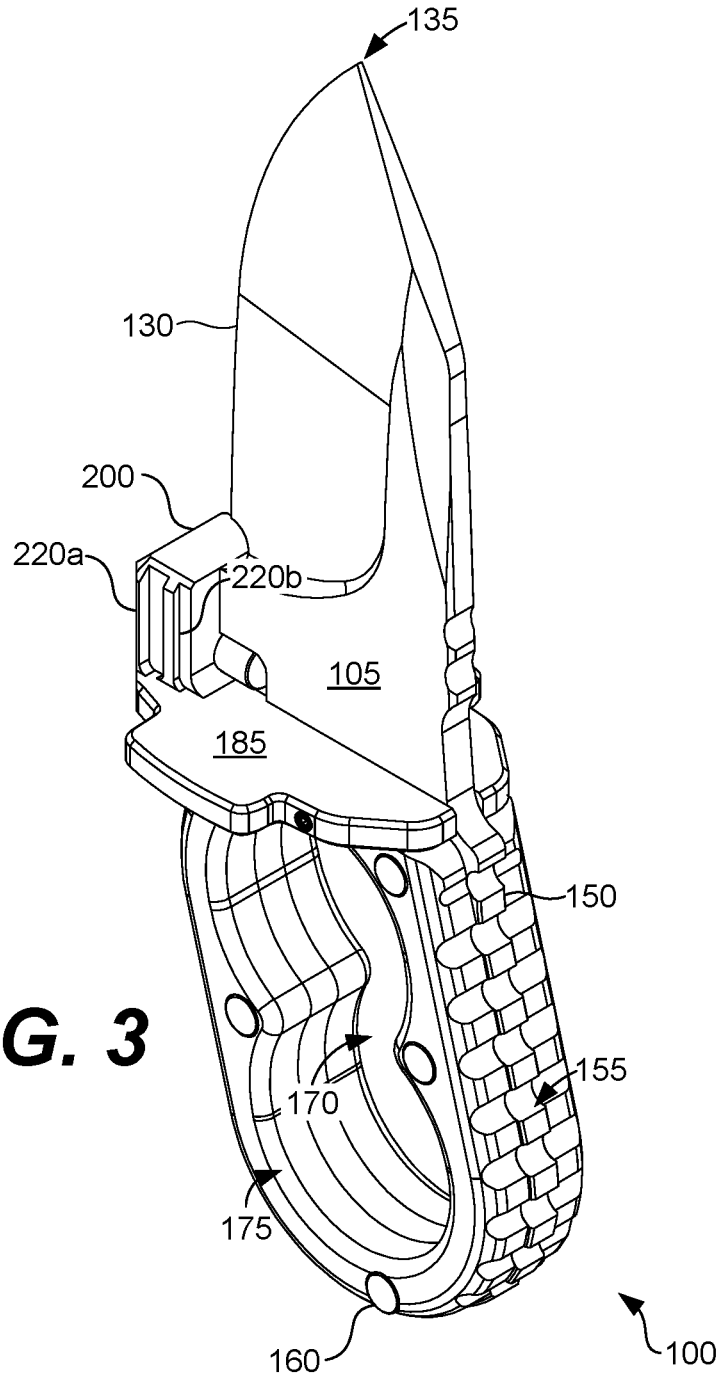
FIG. 3 shows a rear perspective view of the knife of FIG. 1 according to various embodiments of the present disclosure.
Figure 4:
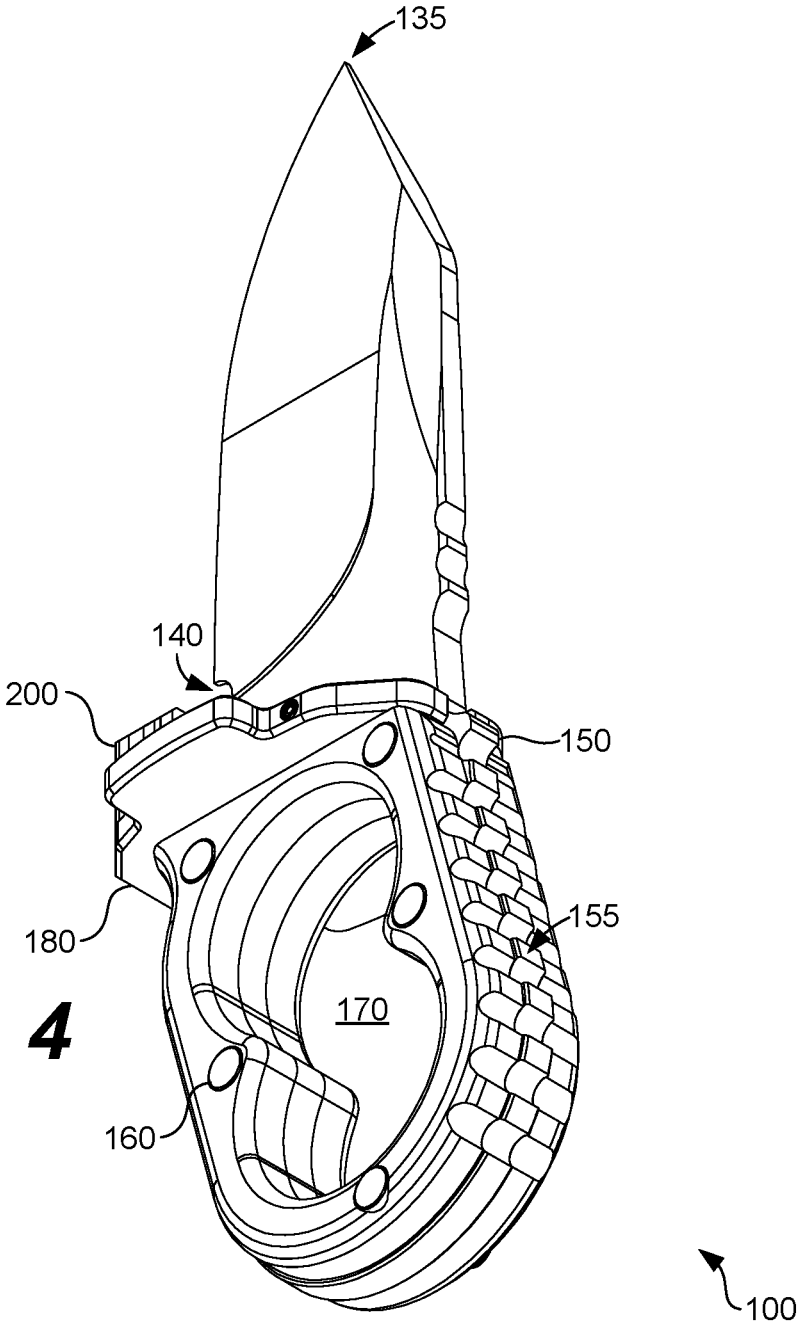
FIG. 4 shows a bottom perspective view of the knife of FIG. 1 according to various embodiments of the present disclosure.
Figure 5:
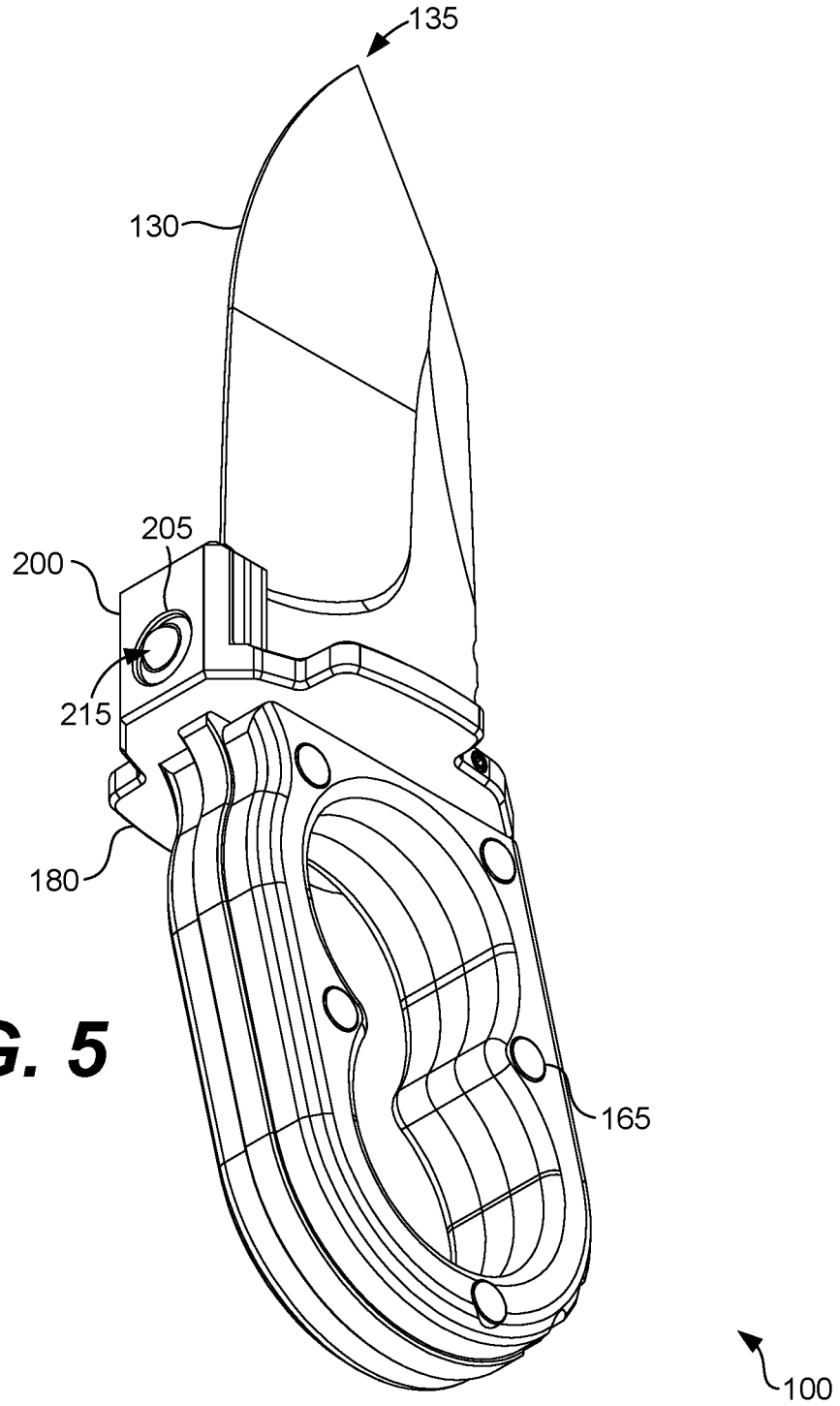
FIG. 5 shows another bottom perspective view of the knife of FIG. 1 according to various embodiments of the present disclosure.

As shown in FIG. 3, the attachment mechanism 200 may include a plurality of rails 220*a*, 220*b* (collectively "rails 220") positioned on respective sides of the attachment mechanism 200. As may be appreciated, the rails 220 may be positioned within channels internal to the interior of the grip of the firearm (not shown).

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, the person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The terms "first", "second", etc. are used only as labels, rather than a limitation for a number of the objects.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A knife, comprising:

a blade body having a first blade side and a second blade side, the blade body further comprising a base and a knife edge portion;

a handle portion sized and positioned to ergonomically adapt to a hand, the handle portion comprising:

the base of the blade body;

a first handle attachment coupled to the base on the first blade side; and a second handle attachment coupled to the base on the second blade side, wherein each of the base of the blade body, the first handle attachment, and the second handle attachment comprises a recess defining a finger support structure; and a guard positioned between the base and the knife edge portion of the blade body, wherein the guard comprises an attachment mechanism coupled thereto, the attachment mechanism being adapted to detachably attach to a grip of firearm and sheath at least the knife edge portion in an interior of the grip.

2. The knife of claim 1, wherein the finger support structure comprises at least two circular ribs, each of the at least two circular ribs being adapted to support a respective finger of an operator.

3. The knife of claim 2, wherein the finger support structure comprises only two circular ribs, a first one of the circular ribs being adapted to support an index finger and a second one of the circular ribs being sized and positioned to support a middle finger of the operator.

4. The knife of claim 1, wherein:

the guard further comprises a flat surface having an elongated aperture configured to nest a portion of the blade body therein;

the guard has a first side projecting beyond the first blade side and a second side projecting beyond the second blade side; and the attachment mechanism projects perpendicularly from a distal end of the flat surface.

5. The knife of claim 4, wherein the attachment mechanism comprises a circular recess positioned on an outer face of the attachment mechanism, the circular recess comprising a male detent mechanism configured to detachably attach to a female detent mechanism positioned in the interior of the grip.

6. The knife of claim 5, wherein the attachment mechanism is configured to release from the grip of the firearm in response to an application of a horizontal lateral force relative to a longitudinal axis of the firearm.

7. The knife of claim 4, wherein the guard is further coupled to the blade body via a pin positioned through an aperture positioned on sides of the flat surface and an aperture positioned on a rear portion of the blade body.

8. The knife of claim 1, wherein the first handle attachment and the second handle attachment are positioned on the base of the blade body to define a tang.

9. The knife of claim 8, wherein the tang of the knife comprises a plurality of ridges.

10. The knife of claim 1, wherein the first handle attachment and the second handle attachment are coupled to the blade body using a plurality of screws and a plurality of rivet nuts.

11. A rifle, comprising:

a lower receiver;

a grip extending from the lower receiver; and a knife configured to sheath within an interior of the grip, the knife comprising:

a blade having a first blade side and a second blade side, the blade further comprising a base and a knife edge portion;

a handle portion comprising:

the base of the blade;

a first handle attachment coupled to the base on the first blade side; and a second handle attachment coupled to the base on the second blade side; and a guard positioned between the base and the knife edge portion, wherein the guard comprises an attachment mechanism coupled thereto, the attachment mechanism being adapted to detachably attach to the grip of the rifle and sheath at least the knife edge portion in an interior of the grip.

12. The rifle of claim 11, wherein:

each of the base of the blade body, the first handle attachment, and the second handle attachment comprise a recess defining a finger support structure; and the finger support structure comprises at least two circular ribs, each of the at least two circular ribs being adapted to support a respective finger of an operator.

13. The rifle of claim 12, wherein the finger support structure comprises only two circular ribs, a first one of the circular ribs being adapted to support an index finger and a second one of the circular ribs being sized and positioned to support a middle finger of the operator.

14. The rifle of claim 12, wherein:

the guard further comprises a flat surface having an elongated aperture configured to nest a portion of a blade of the blade therein;

the guard has a first side projecting beyond the first blade side and a second side projecting beyond the second blade side; and the attachment mechanism projects perpendicularly from a distal end of the flat surface.

15. The rifle of claim 12, wherein:

the attachment mechanism comprises a circular recess positioned on an outer face of the attachment mechanism, the circular recess comprising a male detent mechanism configured to detachably attach to a female detent mechanism positioned in the interior of the grip of the rifle; and the attachment mechanism is configured to release from the grip of the rifle in response to an application of a horizontal lateral force relative to a longitudinal axis of the rifle.

16. The rifle of claim 12, wherein the first handle attachment and the second handle attachment are positioned on the base of the blade to define a tang, the tang of the knife comprising a plurality of ridges.

17. A method, comprising providing the knife of claim 1.

18. A method, comprising:

providing the rifle of claim 11; and positioning the knife within the grip of the rifle such that at least the knife edge portion is sheathed in an interior of the grip.

19. A knife, comprising:

a blade body having a first blade side and a second blade side, the blade body further comprising a base and a knife edge portion;

a handle portion sized and positioned to ergonomically adapt to a hand, the handle portion comprising the base of the blade body and handle attachments coupled to sides of the base;

a guard positioned between the base and the knife edge portion of the blade body, wherein:

the guard comprises an attachment mechanism coupled thereto adapted to detachably attach to a grip of a firearm and sheath at least the knife edge portion in an interior of the grip;

the guard further comprises a flat surface having an elongated aperture configured to nest a portion of the blade body therein;

the guard has a first guard side projecting beyond the first blade side and a second guard side projecting beyond the second blade side;

the attachment mechanism projects perpendicularly from a distal end of the flat surface; and the guard is further coupled to the blade body via a pin positioned through an aperture positioned on sides of the flat surface and an aperture positioned on a rear portion of the blade body.

20. A firearm, comprising:

a grip; and a knife configured to sheath within an interior of the grip, the knife comprising:

a blade having a first blade side and a second blade side, the blade further comprising a base and a knife edge portion;

a handle portion comprising the base of the blade and handle attachments coupled to sides of the base, the handle portion comprising a recess defining a finger support structure; and a guard positioned between the base and the knife edge portion, wherein the guard comprises an attachment mechanism coupled thereto, the attachment mechanism being adapted to detachably attach to the grip of the firearm and sheath at least the knife edge portion in an interior of the grip.

* * * * *